United States Patent [19]

McDonald

[11] 4,350,574

[45] Sep. 21, 1982

[54] METHOD FOR DEPOSITING AN OXIDE COATING

[75] Inventor: Glen E. McDonald, Strongsville, Ohio

[73] Assignee: The United States of America as represented by the Administrator of the National Aeronautics and Space Administration, Washington, D.C.

[21] Appl. No.: 246,772

[22] Filed: Mar. 23, 1981

[51] Int. Cl.[3] ..... C25B 1/02

[52] U.S. Cl. ..... 204/56 R

[58] Field of Search ..... 204/56 R

[56] References Cited

U.S. PATENT DOCUMENTS

| | | | |
|---|---|---|---|
| 2,733,199 | 1/1956 | Wick | 204/56 |
| 2,844,530 | 2/1958 | Wesley et al. | 204/40 |
| 3,723,261 | 3/1973 | Byers et al. | 204/51 |
| 4,080,269 | 3/1978 | Scholz et al. | 204/56 R |
| 4,094,750 | 6/1978 | Mackey | 204/56 R |
| 4,111,760 | 9/1978 | Chen et al. | 204/48 |
| 4,239,604 | 12/1980 | Mahdjuri | 204/56 R |
| 4,296,182 | 10/1981 | Matsubayashi et al. | 204/51 |

*Primary Examiner*—R. L. Andrews

*Attorney, Agent or Firm*—Norman T. Musial; John R. Manning; Gene E. Shook

[57] ABSTRACT

According to the invention a metal oxide coating is plated onto a metal substrate at the cathode from an acid solution which contains an oxidizing agent. The process is particularly useful for producing solar panels.

Conventional plating at the cathode avoids the presence of oxidizing agents. Coatings made in accordance with the invention are stable both at high temperatures and while under the influence of high photon flux in the visible range.

4 Claims, No Drawings

METHOD FOR DEPOSITING AN OXIDE COATING

ORIGIN OF THE INVENTION

The invention described herein was made by an employee of the United States Government and may be manufactured and used by or for the Government for governmental purposes without the payment of any royalties thereon or therefor.

TECHNICAL FIELD

This invention is concerned with coating a substrate with a black metal oxide film that is highly absorbing. The invention is particularly directed to an improved electrodeposition process for producing solar collectors.

Such devices collect energy from the sun for conversion to heat and electrical power. These devices utilize flat panels to collect the energy.

It has been suggested that the heating panels be selectively coated to increase the energy absorbing properties. Such solar heating panels may be coated with black paint which is inexpensive and absorbs solar energy. However, such a coating is not very durable because paint will flake and chip. Black paint also enables much of the absorbed energy to be lost by emittance.

Coatings of both black nickel and black chrome have been used for solar heating panels. Black nickel is a good heat conductor, but coatings of this material are vulnerable to moisture. Black chrome loses some of its stability at high operating temperatures.

The coatings used for solar heating panels must have high absorptance in the visible range and low emittance in the infrared range for optimum results. These coatings should be stable both at high temperatures and while under the influence of high photon flux in the visible range. The coatings should be able to be applied with readily available equipment in an economical manner.

Various processes have been used to coat substrates for use in solar heating panels. However, many of these coatings were unsatisfactory because they were either not stable at solar collector operating temperatures or were expensive and difficult to apply.

BACKGROUND ART

Wick U.S. Pat. No. 2,733,199 discloses a process for cathodically depositing chromium films on metal from a solution while Wesley et al U.S. Pat. No. 2,844,530 describes the electrodeposition of a black nickel coating on metal.

U.S. Pat. No. 2,917,817 to Tabor is directed to thin exposed light absorptive and heat transparent surface coatings, which are in heat conductive relation to a bright metal base. Solar heating panels utilizing these coatings have been expensive and difficult to produce.

McDonald U.S. Pat. No. 4,055,707 describes a black chrome coating for solar panels which is electroplated onto a metal substrate. Several electroplating solutions are described in this patent.

Scholz et al U.S. Pat. No. 4,080,269 discloses a method for producing a black coating which is highly absorbant in the solar spectrum range using electrodeposition from an aqueous solution containing a soluble cobalt compound. A large amount of alkali thiocyanate is used in the disclosed process.

A process for depositing an oxide layer from a solution containing a metal salt and isopropynol is disclosed in Mackey U.S. Pat. No. 4,094,705. The patent fails to mention the solar absorption properties of the oxide layer.

Schardein et al U.S. Pat. No. 4,104,136 describes a process for applying thin metal coatings to a substrate for solar energy absorption. The process provides for electrochemically plating a clean aluminum surface in a solution containing ammonium molybdate.

DISCLOSURE OF INVENTION

According to the present invention the metal coating is oxidized as it is deposited. This produces a black metal oxide film that is highly absorbing.

An appropriate quantity of an oxidizing agent is added to a plating solution. The metal coating is then plated at the cathode.

Conventional plating at the cathode rigorously avoids the presence of oxidizing agents.

BEST MODE FOR CARRYING OUT THE INVENTION

A metal substrate to be coated in accordance with the present invention may have any of a number of different configurations. By way of example, the substrate may be a plate, bar, or tube. Also, the substrate may or may not have low emittance.

If there is no concern about emittance of the collector but only with obtaining a stable, low cost, high absorptance coating, then the metal oxide may be plated directly onto the substrate. If both high absorptance and low emittance are desired, the metal oxide may be plated on a metal substrate which has low emittance. Also in this situation the coating may be plated onto a suitable low emittance foil. Further, the metal oxide coating may be electroplated on a coating which has been deposited previously onto the metal substrate.

According to the present invention a metal oxide coating is plated onto the metal substrate at the cathode from an acid solution which contains an oxidizing agent. By way of example, a black cobalt oxide has been plated from a solution having the following composition at the listed parameters:

44 ounces/gal. of cobalt sulfate
6 ounces/gal of cobalt chloride
5 ounces/gal of boric acid
PH of 3.5
Temperature of 115° F.
Current density-40 amps/sq. ft.

An oxidizing agent, such as 10 ml/liter of 30 percent $H_2O_2$, is added to the solution and plated for a sufficient time to produce an oxide coating of 1 to 2 micrometers.

Practices known to the trade in creating a uniform current density across the surface are utilized. Also, an addition of plating assisting agents, such as wetting or surface tension adjusting agents, may be used.

Other oxidizing agents known to the trade may be used. Also, other acids and/or buffers may be used for plating at the stated PH. It is contemplated these other materials may be used for plating at other PHs between 1.0 and 6.0.

It is further contemplated that other concentrations of $H_2O_2$ may be used. Air agitation or mechanical agitation of the solution may be desirable. Also, the plating may be performed in an unstirred solution.

It is further contemplated that the cobalt may be replaced in varying amounts with other metals, or combinations of other metals. These substitute metals include, but are not limited to, nickel, chromium, manganese, and vanadium. These other metals can produce properties in the deposited oxide coating which may be desired, such as altered absorptance spectrum or thermal stability.

It is further contemplated that other current densities may be used to obtain certain desirable results. One advantage of the process of the present invention is that a deposit of an oxide can be produced at much lower current densities than black chrome can be deposited.

Prior to coating the metal substrate to be plated is suitably cleaned in accordance with known pratices. The substrate is then rinsed with clean water and electroplated at the cathode in the solution as aforementioned.

The coatings produced in accordance with the described process are adherent and stable at temperatures higher than 1200° F. Certain of these oxide coatings, such as cobalt oxide, has high absorptance in the visible spectrum. This absorptance may be 95 percent or higher. This absorptance is stable to temperatures in excess of 1200° F.

The materials described for making the solution are much lower in cost than conventional electroplating solutions required to produce conventional electroplated coatings.

Another beneficial technical effect resulting from this process is that control of the current density produces a black coating of sufficient thickness to be highly absorbant, and it can be produced on a surface of low emittance in the required thicknesses to have the combination of both high absorptance in the visible range and low emittance in the infrared range.

While the preferred embodiment of the invention has been described, it will be appreciated that various modifications may be made to the procedure without departing from the spirit of the invention and the scope of the subjoined claims.

I claim:

1. In a method of coating a substrate with a black metal oxide film from an electroplating solution containing about 44 ounces per gallon (a salt of a metal selected from the group consisting essentially) of cobalt sulfate, about 6 ounces per gallon of cobalt chloride, and about 5 ounces per gallon of boric acid having PH in the range between about 1.0 and about 6.0 at a temperature of about 115° F. (, nickel, chromium, and manganese) to form a solar collector that is highly absorbing, the improvement comprising adding an oxidizing agent to said plating solution, mounting said substrate in said solution to form a cathode, and electrodepositing cobalt (said metal) from said solution onto said substrate at said cathode by passing a current of about 40 amps per square foot of substrate therethrough while simultaneously oxidizing the same.

2. A method as claimed in claim 1 wherein the oxidizing agent is $H_2O_2$.

3. A method as claimed in claim 2 wherein 10 ml/liter of 30 percent $H_2O_2$ is added to the electroplating solution.

4. A method as claimed in claim 1 wherein the electroplating solution has a PH of about 3.5.

* * * * *

UNITED STATES PATENT OFFICE

CERTIFICATE OF CORRECTION

Patent No. 4,350,574 Dated September 21, 1982

Inventor(s) Glen E. McDonald

It is certified that error appears in the above-identified patent and that said Letters Patent are hereby corrected as shown below:

Claim 1, lines 11 and 12, cancel "(a salt of a metal selected from the group consisting essentially)"

lines 16 and 17, cancel "(, nickel, chromium, and manganese)"

line 22, cancel "(said metal)"

Signed and Sealed this

Seventh Day of December 1982

[SEAL]

Attest:

GERALD J. MOSSINGHOFF

Attesting Officer

Commissioner of Patents and Trademarks